US010183511B2

(12) United States Patent
Bapst et al.

(10) Patent No.: US 10,183,511 B2
(45) Date of Patent: Jan. 22, 2019

(54) WEB SUPPORT AND STABILIZATION UNIT FOR A PRINTING HEAD, AND PRINTING STATION EQUIPPED THEREWITH

(71) Applicant: BOBST MEX SA, Mex (CH)

(72) Inventors: Sylvain Bapst, Bulle (CH); Alain Mayor, Bussigny (CH); José-Manuel Romero, Bussigny (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 15/550,555

(22) PCT Filed: Feb. 5, 2016

(86) PCT No.: PCT/EP2016/025005
§ 371 (c)(1),
(2) Date: Aug. 11, 2017

(87) PCT Pub. No.: WO2016/128144
PCT Pub. Date: Aug. 18, 2016

(65) Prior Publication Data

US 2018/0022120 A1 Jan. 25, 2018

(30) Foreign Application Priority Data

Feb. 12, 2015 (EP) ..... 15020021

(51) Int. Cl.
*B41J 15/16* (2006.01)
*B41J 15/04* (2006.01)
*B41J 11/00* (2006.01)

(52) U.S. Cl.
CPC ..... *B41J 15/16* (2013.01); *B41J 11/0085* (2013.01); *B41J 15/04* (2013.01); *B41J 15/048* (2013.01)

(58) Field of Classification Search
CPC ..... B41J 15/04; B41J 15/048; B41J 15/16; B41F 23/0426; B65H 20/14; B65H 23/24;
(Continued)

(56) References Cited

U.S. PATENT DOCUMENTS 4,074,841 A * 2/1978 Kramer ..... B65H 23/24 226/97.3
4,137,644 A * 2/1979 Karlsson ..... B65H 23/24 226/196.1

(Continued)

FOREIGN PATENT DOCUMENTS

EP 0 959 033 A2 11/1999
FR 2 905 302 A1 3/2008
JP 2014-223974 A 12/2014

OTHER PUBLICATIONS

International Search Report dated Apr. 29, 2016 in corresponding PCT International Application No. PCT/EP2016/025005.

(Continued)

*Primary Examiner* — Anh T. N. Vo
(74) *Attorney, Agent, or Firm* — Ostrolenk Faber LLP

(57) ABSTRACT

A support and stabilization unit (200, 300, 400, 500) for a web (20) advancing in its longitudinal direction over the unit from upstream to downstream; the unit includes in series at least one rotating support roller (31, 32) that is able to come into contact with an underside of the web (20), and at least one device (121, 122, 122') for tensioning the web (20). The tensioning device (121, 122, 122') includes a guiding face (121*a*, 122*a*) oriented toward the underside of the web (20), an internal cavity connected to the outside of the device via an outlet opening (121*d*) which is oriented toward the guiding face (121*a*, 122*a*), and an air inlet inside the internal cavity (121*b*), so as to produce, on the web (20), a force (F2) oriented toward the guiding face (121*a*, 122*a*).

13 Claims, 7 Drawing Sheets

(58) Field of Classification Search
CPC ..... B65H 2406/112; B65H 2406/12; B65H 2406/121; B65H 2406/323; B65H 2406/331; D21F 5/188; F26B 13/10; F26B 13/104
See application file for complete search history.

(56) References Cited

U.S. PATENT DOCUMENTS

| | | | | |
|---|---|---|---|---|
| 4,472,888 | A * | 9/1984 | Spiller | B41F 23/0426 226/196.1 |
| 4,698,914 | A * | 10/1987 | Shu | F26B 13/104 226/7 |
| 5,056,431 | A | 10/1991 | Sainio | 101/219 |
| 5,347,726 | A | 9/1994 | Quadracci et al. | 34/465 |
| 6,936,137 | B2 * | 8/2005 | Moeller | B65H 20/14 162/193 |
| 7,528,400 | B2 * | 5/2009 | Duck | D21F 7/06 250/559.23 |

OTHER PUBLICATIONS

Written Opinion dated Apr. 29, 2016 in corresponding PCT International Application No. PCT/EP2016/025005.

* cited by examiner

WEB SUPPORT AND STABILIZATION UNIT FOR A PRINTING HEAD, AND PRINTING STATION EQUIPPED THEREWITH

CROSS-REFERENCE TO RELATED APPLICATIONS

The present application is a 35 U.S.C. §§ 371 national phase conversion of PCT/EP2016/025005, filed Feb. 5, 2016, which claims priority to European Patent Application No. 15020021.0, filed Feb. 12, 2015, the contents of which are incorporated herein by reference. The PCT International Application was published in the French language.

TECHNICAL BACKGROUND

The present invention relates to a support and stabilization unit for a continuous web, used in particular for a printing head. Such a printing head can be used for contactless printing of information and/or patterns on a web of primary material that can be of variable thickness and can be made of various types of material, in particular a plastic material. The invention also relates to a printing station equipped with at least one printing head and at least one support and stabilization unit. In particular, the present invention relates to the manufacture of packaging, and in particular packaging using flat elements cut from a previously printed web.

PRIOR ART

In the manufacture of packaging, high work rates are achieved for the processing of webs, in particular webs made of plastic material. Thus, web speeds can be as high as 600 m/min on a single machine which can continuously carry out multiple processes in succession, such as one or more printing operations, coating before and/or after printing, embossing or debossing, over multiple modules arranged in series. At the end of the line, the web is either rolled back onto a reel, known as reel-to-reel printing, or there follows a module that cuts and discards offcuts, wherein this latter operation must be carried out in strict agreement with the prior printing.

There are various types of printing modules, in particular depending on the printing method used. For small-batch printing; use is now increasingly made of digital printing. However, this type of printing requires extreme precision between the printing heads and the position of the web, in every direction of the web: the relative position of the web with respect to the printing head in the directions of length, width and height must be adjusted spatially and temporally in order to synchronize the printing and cutting processes. Furthermore, in the case of digital printing, there are multiple printing heads for the various colors of ink, and also sometimes multiple printing heads to cover the entire width of the web when the web is wider than the printing heads.

Furthermore, in the case of high or very high web speeds, the web is liable to vibrate and undulate. This presents an increased problem as the means for supporting and driving the web do not make it possible to maintain sufficient contact and tension in the web.

Therefore, in the case of high or very high web speeds, it is difficult to obtain good spatial and temporal agreement between the printing heads and the position of the web.

Furthermore, in order to guide and stabilize the web, since ink is deposited during printing, that face of the web must not be touched by or come into contact with any element whatsoever until the ink is dried, that is to say during its passage through the printing module, and at least also during its passage through one or more modules which follow the printing module, in order to permit drying without impairing the print quality.

Since it is thus not possible to make contact with the web face that is to be printed, and moreover to compress the web by pressing on the web, the proposed techniques essentially involve using a vacuum that creates a region of reduced pressure at the web face opposite the printed face, which is generally the underside of the web. However, this suction of the underside of the web adds friction between the web and the suction means, which is liable to disrupt the tension of the web, in particular for webs consisting of thin films. Furthermore, this reduced pressure also carries the risk of disrupting the flow of air at the one or more printing heads, and thus of degrading the print quality.

SUMMARY OF THE INVENTION

One object of the present invention is to propose a support and stabilization unit that does not have the limitations of the known devices. A second object of the invention is to propose a support and stabilization unit which permits good precision of the relative position between the web and the one or more printing modules that cooperate with this support and stabilization unit. Another object is to try also to tension the web in order to have a web with a printing face that is both well-positioned in all dimensions and also properly planar, in order to ensure a printing quality with little or no degradation in comparison to the printing quality offered by the modules and/or printing heads on a fixed surface. In addition, the invention has the object of stabilizing the web with no contact with the printing face of the web. This is done at least along the entire length of the stabilization device in order to avoid disrupting the face that is to be printed, whether prior to printing, during printing or after printing when the web is covered with ink that is drying.

According to the invention, these objects are achieved by means of a support and stabilization unit for a web advancing in its longitudinal direction over the unit from upstream to downstream, wherein one unit comprises in series:

- at least one rotating support roller that is configured to come into contact with an underside of the web, and
- at least one device for tensioning the web, comprising
  - a guiding face oriented toward the underside of the web,
  - an internal cavity connected to the outside of the device via an outlet opening which is oriented toward the guiding face, and
  - an air inlet inside the internal cavity, so as to produce, on the web, a force oriented toward the guiding face.

This solution is based on the arrival of a high-speed air flow between the web and the guiding face, so as to form a region of reduced pressure between these two. This flow of air will tend to draw the web toward the guiding face, in order to hold the web at the guiding face. This produces a stable position of the web along the guiding face, without undulation or other irregularity in the shape of the web which follows the contour of the guiding face. Thus, the web remains planar, if the guiding face is planar.

Furthermore, this situation produces tension in the web, in a direction parallel to the longitudinal direction of the web, due to the fact that the web is constantly advancing in its longitudinal direction. The tension is oriented from the outlet opening toward the guiding face.

This solution has the advantage of not creating friction between the advancing web and its support, which is of great importance in regard to printing modules and/or heads, where precise positioning of the web at all times is paramount. Indeed, this precision is necessary in order to ensure both the quality of the printing and also the correct position of the image and/or the text printed on the web, particularly for strict superposition of the patterns printed from one printing module or head to the next. Most of the time it is necessary to use multiple printing modules or heads distributed in series along the longitudinal direction of the web, in particular for printing using different-colored inks, and/or multiple printing modules distributed in offset fashion in a row or in a staggered pattern along the transverse direction of the web. This is done when the length of the printing modules does not make it possible to cover the entire width of the web.

The configuration of the system as a whole, and especially the positioning of the devices for tensioning the web, makes it possible to minimize any aeraulic disturbance connected to the vein of air at the one or more printing modules and/or heads, which permits optimum ejection of the ink in the case of digital printing.

Furthermore, this flow of air can help to reduce the temperature of the substrate.

For example, a convex connecting face may be formed between the outlet opening and the guiding face. This arrangement makes it possible for the flow of air to be guided easily in the direction of the guiding face, and to engage between the guiding face and the web with practically no disturbance, apart from the change in direction.

The highest point of the support roller can be positioned above the highest point of the guiding face. This causes a better effect of holding the web on the support roller due to the web being drawn in the direction of the device for tensioning the web by the flow of air produced by the device for tensioning the web.

The angular orientation, the longitudinal position and the distance of the device for tensioning the web, with respect to the web, may be adjustable. This makes it possible to adapt the distance between the tensioning device and the web, to form a flow of air that has the correct properties of velocity and flow rate to hold the web in the direction of the support roller and to obtain the appropriate tension for a good print quality.

The outlet opening can be located upstream or downstream of the guiding face, depending on the orientation chosen for the device for tensioning the web.

The support and stabilization unit can further comprise at least one rotatable anti-vibration roller arranged between the support roller and the device for tensioning the web. The purposes of the anti-vibration roller are to serve as a guide and to accompany the web as it advances, while helping to damp the vibrations of this web moving at high speed.

The highest point of the anti-vibration roller can be positioned above the highest point of the guiding face of the adjacent device for tensioning the web. And the highest point of the anti-vibration roller can be positioned below the highest point of the adjacent support roller. Thus, the web which is in contact with the support roller adjacent to the anti-vibration roller is also in contact with the anti-vibration roller. Indeed, this contact is ensured in particular by virtue of the tensioning produced by the tensioning device adjacent to the anti-vibration roller, and by virtue of the offset of the positions of the tops of the elements present in the unit. The offset is between the support roller, then the anti-vibration roller, which is located at an intermediate distance, and finally the tensioning device.

The support and stabilization unit may further comprise two adjacent rotating support rollers. The support and stabilization unit can further comprise two devices for tensioning the web.

The support and stabilization unit may further comprise two anti-vibration rollers which are located on either side of the support rollers and the highest point of the anti-vibration rollers is arranged at a lower elevation than the highest point of the support rollers.

The tensioning device may comprise an air manifold which delimits the internal cavity. The external face of the air manifold may comprise the guiding face. The manifold has a slot that connects the internal cavity to the guiding face and that delimits the outlet opening. The manifold may extend over a distance that is suitable for covering at least the width of the web.

According to another aspect of the invention, a printing station is equipped with at least one printing head and at least one support and stabilization unit as described herein. In the printing station, the one or more printing heads are arranged above the support and stabilization unit and face the support roller.

According to another aspect of the invention, a printing machine comprises a printing station as described herein, and each one of the printing heads delivers ink of a different color.

BRIEF DESCRIPTION OF THE FIGURES

Exemplary embodiments of the invention are indicated in the description illustrated by means of the appended figures, in which.

EXEMPLARY EMBODIMENTS OF THE INVENTION

In the rest of the description, the terms upstream and downstream are defined with respect to the direction of advance of the web, and with respect to a printing head. An upstream element is located in the zone preceding the printing head with respect to the direction of advance of the web, and a downstream element is located after the printing head with respect to the direction of advance of the web.

Figure 1:
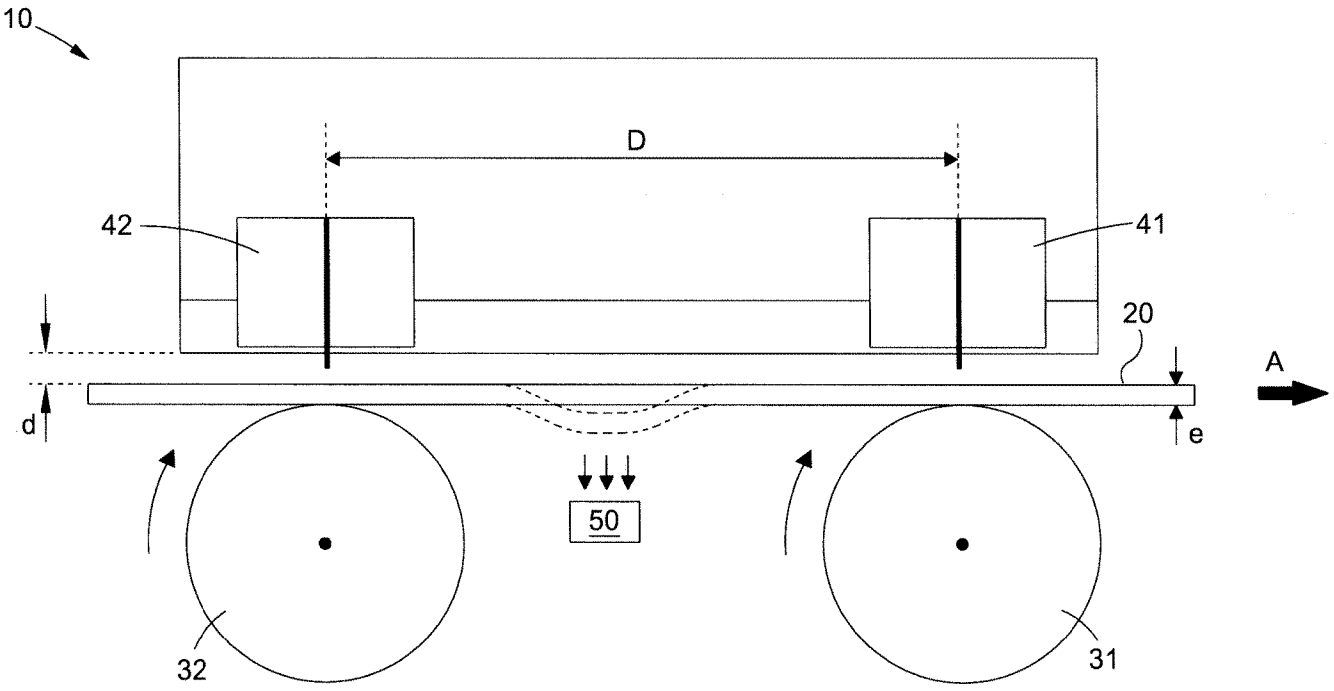
Fig. 1 Prior Art
FIG. 1 shows a printing module of the prior art.

In FIG. 1, a printing head 10 is used to print the upper face of a web 20 running continuously in the longitudinal direction of the web (arrow A in FIG. 1). To that end, a first downstream printing module 41 is spaced apart, by a distance D, from a second upstream printing module 42 in the longitudinal direction of the web. The first printing module 41 and the second printing module 42 are arranged above the upper face of the web 20, in order to print on the web 20 as the web passes by.

This illustrated printing head 10 example comprises two printing modules 41 and 42. These two printing modules 41 and 42 deliver ink of a single color for example. These two printing modules 41 and 42 for example, also extend over the entire width of the web. According to another example configuration, particularly where the two printing modules 41 and 42 deliver one ink, these two printing modules 41 and 42 are not wide enough to cover the entire width of the web 20, and so are positioned offset in the transverse direction of the web 20. The printing heads can comprise more printing modules, arranged in a staggered pattern on two different transverse rows across the web.

Support and stabilization are provided by two rollers 31 and 32 used respectively opposite and vertically in line with each printing module 41 and 42, respectively. These support rollers 31 and 32 are not motorized, but each rotates freely about a respective horizontal axis which is orthogonal to the longitudinal direction of the web 20. Each roller 31 and 32 is positioned such that its highest point is spaced apart from the corresponding printing module 41, 42, arranged opposite each other, by a height e+d. The height e is the thickness of the web 20 passing over the rollers 31 and 32, and the height d is the vertical spacing between the web 20 and each printing module 41 or 42. Maintaining a predetermined vertical spacing d is paramount for optimal print quality.

However, the mere presence of the rollers 31 and 32 which guide the web to keep the web at the correct distance from the printing modules 41 and 42 is not sufficient to adequately hold the web 20. Indeed, in this case, the web 20 is subject to vibrations or even undulations, with resultant irregular tensions, such that in spite of a certain permitted tolerance in the value d, it is difficult to guarantee a sufficiently precise position for the print quality to be acceptable under all circumstances.

It is for this reason that some printing heads 10 of the prior art are also equipped with one or more suction modules 50 (FIG. 1). This suction module 50 is for example placed between the rollers 31 and 32, underneath the web 20. When the suction module 50 is activated, a vacuum is produced underneath the web 20, which therefore tends to draw the web downward and creates a downward deformation in the form of an undulation. The peak of the undulation points toward the suction module 50. Furthermore, as previously indicated, such a vacuum slows the advance of the web 20.

Figure 2:
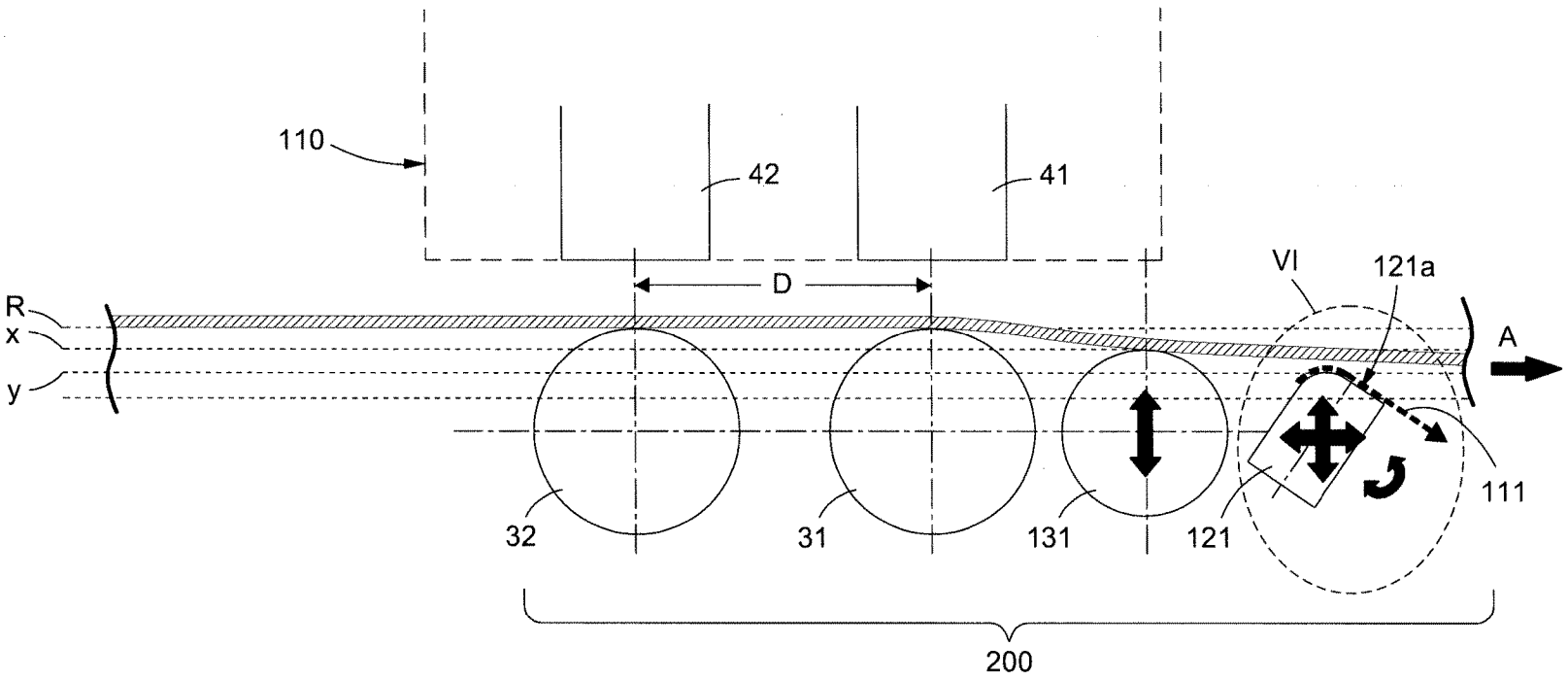
FIG. 2 shows a first embodiment of a support and stabilization unit according to the invention.

According to a first embodiment of the invention in FIG. 2, a printing head 110 is equipped with a support and stabilization unit 200. This support and stabilization unit 200 comprising two adjacent rotating support rollers 31 and 32, comprising a downstream support roller 31 and an upstream support roller 32 positioned in the direction of advance of the web (arrow A). Each roller 31 and 32 is arranged vertically below and in line with a respective printing module 41 and 42, with interposition of the web 20 which rests on the rollers 31, 32 that are mounted so as to be able to rotate freely. The rollers 31 and 32 and the printing modules 41 and 42 are similar to those described previously in relation to FIG. 1.

In this first embodiment, the two rollers 31 and 32 are complemented by a tensioning device 121 which is located downstream of the downstream support roller 31 and therefore downstream of the upstream roller. The tensioning device generates a flow of air 111, which passes between a guiding face 121*a* of the tensioning device 121, located below the flow of air 111, and the underside of the web 20. This flow of air 111 is therefore located in the downstream part of the support and stabilization unit 200. This flow of air 111 flows in the same direction as the web 20. Preferably, the velocity of this flow of air 111 is higher than the speed of advance of the web 20.

The two rollers 31 and 32 are complemented by a downstream anti-vibration roller 131 arranged between the tensioning device 121 and the downstream support roller 31. This downstream anti-vibration roller 131 is free to rotate about a horizontal axis which is orthogonal to the longitudinal direction of the web 20.

The vertical position of the downstream anti-vibration roller 131 is adjustable. The highest point of the support rollers 31 and 32 (see FIG. 2) is taken as a reference level R. Preferably, the downstream anti-vibration roller 131 is positioned such that its highest point is below the highest point of the support rollers 31 and 32. Here, the downstream anti-vibration roller 131 is at a value x with respect to the reference level R, below this reference level R. Also, the tensioning device 121 is preferably positioned such that its highest point is lower than the highest point of the downstream anti-vibration roller 131. The highest point of the tensioning device 121 is preferably a portion of the connecting face 121*e*. Here, the tensioning device 121 is at a value y with respect to the reference level R.

Figure 3:
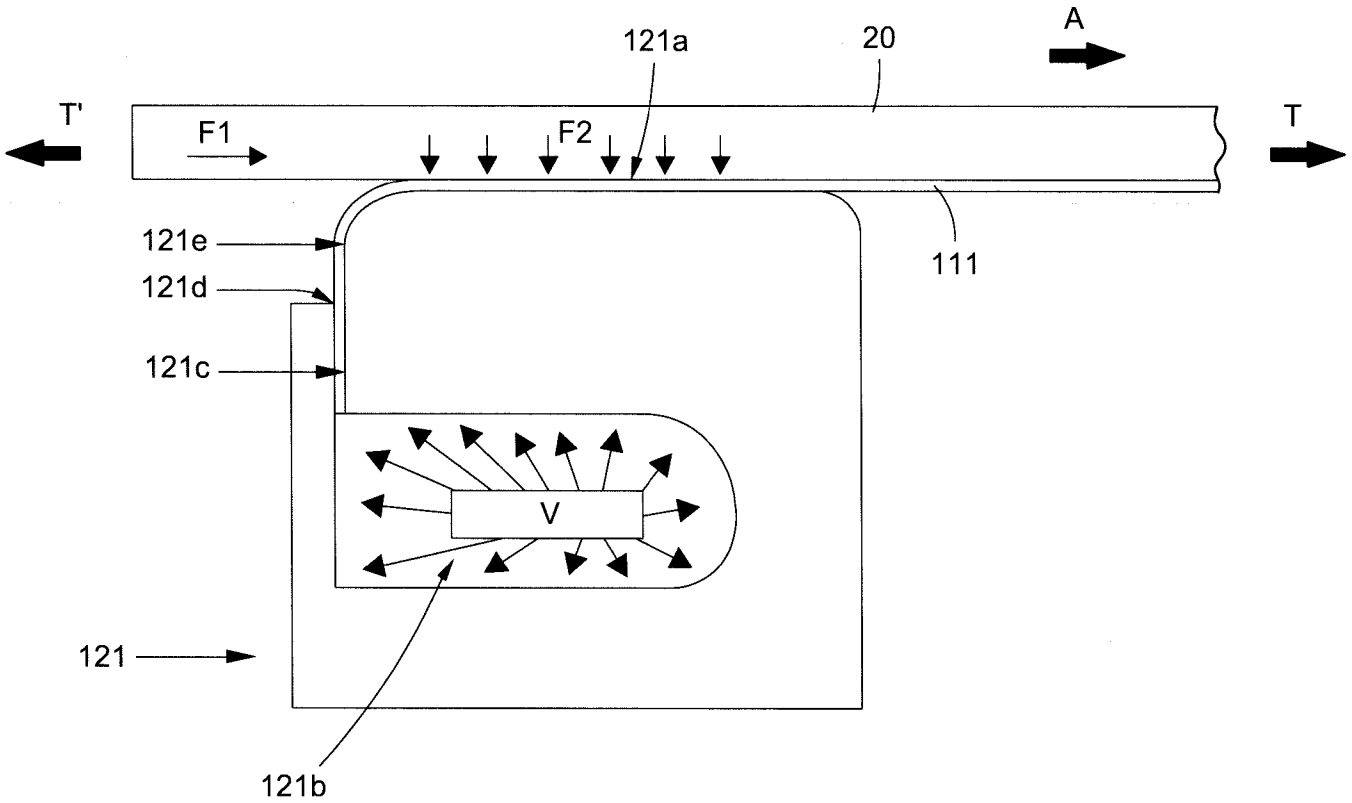
FIG. 3 is an enlarged view of the cross section of the tensioning device with the corresponding segment of web.

FIG. 3 shows the downstream tensioning device 121 in cross section in a vertical plane parallel to the longitudinal direction of the web 20. The guiding face 121*a* in the upper portion is oriented upward and thus faces the web 20. The tensioning device 121 comprises an air manifold which delimits an internal cavity 121*b*, and of which the external face comprises the guiding face 121*a*. The manifold has a slot 121*c* that connects the internal cavity 121*b* to the guiding face 121*a* and that delimits an outlet opening 121*d*. In particular, between the outlet opening 121*d* and the guiding face 121*a*, there is formed a convex connecting face 121*e* that makes it possible to guide the flow of air 111 along the external face of the manifold.

Preferably, the air manifold extends over a distance that is suitable for covering at least the width of the web 20. Alternatively, the tensioning device comprises multiple adjacent manifolds, each covering a portion of the width of the web 20. This single manifold or these multiple adjacent manifolds are advantageously oriented transversely, specifically in a direction orthogonal to the longitudinal direction of the web 20.

The outlet opening 121*d* is located upstream of the guiding face 121*a* (FIG. 3). In this case, the flow of air 111 leaving the internal cavity 121*b*, via the slot 121*c* and as far as the opening 121*d*, then passes along the connecting face 121*e*, progressively changing orientation to come to follow the guiding face 121*a*. The flow of air 111 leaves approximately vertically and thus becomes approximately horizontal in the position shown in FIG. 3. In this configuration, the flow of air formed enters between the web 20 and the guiding face 121*a*, parallel to the web 20 and in the same direction of advance as the web 20 (arrow A). The web 20 is above the flow of air, and the guiding face 121*a* is below the flow of air.

This results in the web being drawn downward, toward the guiding face. These two are separated by the flow of air that accompanies the advancing motion of the web 20. The flow of air 111 produces suction which applies, to the web, a force F2 which is essentially vertical and oriented downward along the guiding face 121*a*, and a driving force F1 which is essentially horizontal and oriented downstream, above the slot 121*c* (FIG. 3). According to another variant which is not shown, in the downstream tensioning device 121, the outlet opening 121*d* is located downstream of the guiding face 121*a*.

Preferably, the flow rate and pressure of air entering the internal cavity 121*b* must be sufficient to create the flow of air 111 which is necessary under the operating conditions. Preferably, the velocity of the air leaving the outlet opening 121*d* of the tensioning device 121 must be sufficient to create the pressure-reduction effect and thus draw the web 20 against the support roller or the anti-vibration roller.

To make it easier to stabilize the web 20, and to make it possible to keep this web 20 in tension, thereby avoiding slackening or undulations, the elements of the support and stabilization unit 200 are placed at offset heights, from top to bottom, from the support rollers 31, 32 to the tensioning device 121. Thus, to that end, the highest point of the anti-vibration roller 131 is positioned above the highest point of the guiding face 121*a* of the adjacent downstream tensioning device 121, and below the highest point of the adjacent downstream support roller 31.

According to one variant, not shown, of this first embodiment, and in particular for lower advance speeds of the web 20, it is possible to dispense with the anti-vibration roller 131. The support rollers 31, 32 are then combined with the tensioning device 121. With this tensioning device 121 acting in the downstream portion of the support and stabilization unit 200, according to the first embodiment, it is possible to tension the web 20 downstream of the two rollers 31 and 32 and thus to maintain a stable position of the web 20.

Also, according to another variant, not shown, of this first embodiment, the support and stabilization unit 200 comprises just a single rotating support roller 31. This is a variant with a single printing head 141.

Figure 4:
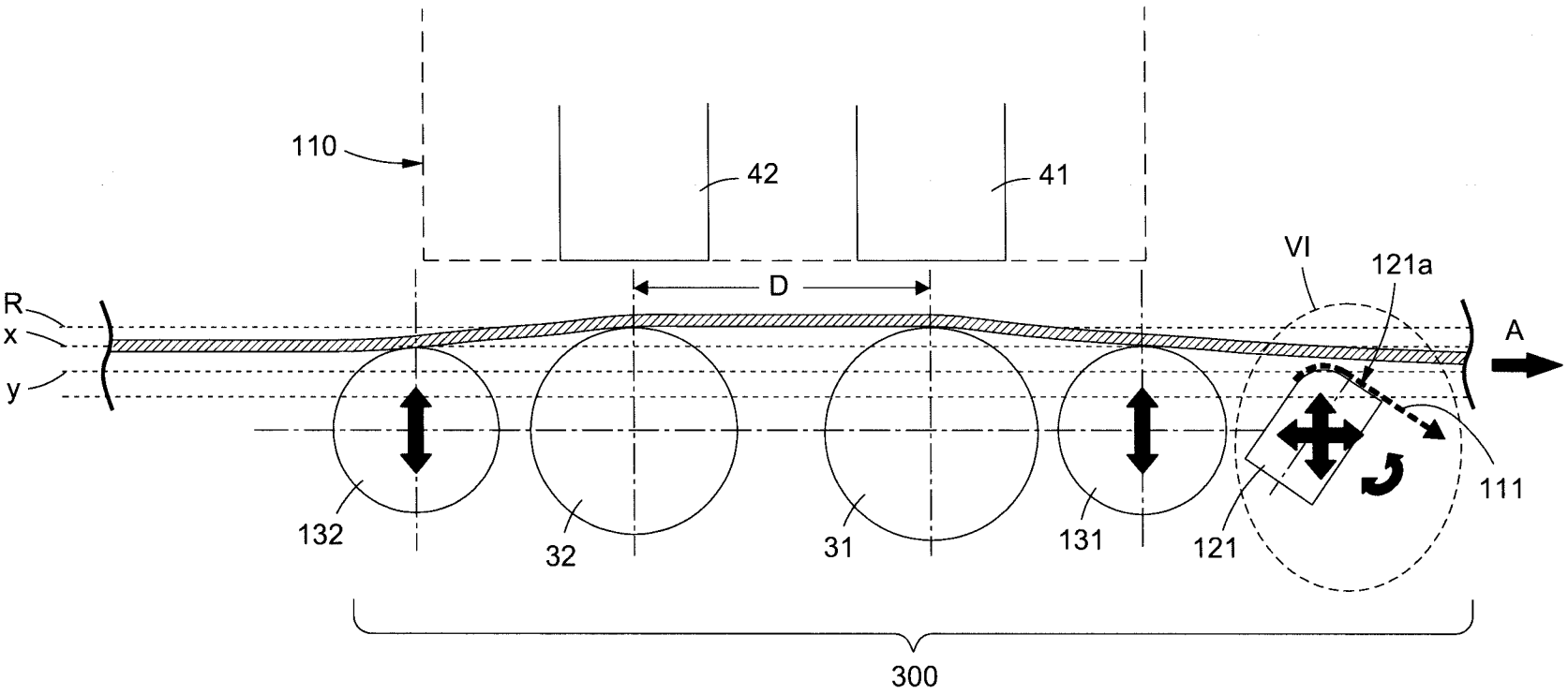
FIGS. 4 to 6 respectively show second, third and fourth embodiments of a support and stabilization unit according to the invention.

A printing head 110 is equipped with a support and stabilization unit 300 according to a second embodiment (FIG. 4). This support and stabilization unit 300 further comprises an upstream anti-vibration roller 132 which is positioned upstream of the upstream support roller 32. In FIG. 4, the upstream anti-vibration roller 132 is located upstream of the support and stabilization unit 300.

Like the downstream anti-vibration roller 131, the vertical position of the upstream anti-vibration roller 132 is adjustable. Likewise, the upstream anti-vibration roller 132 is preferably positioned such that its highest point is below the highest point of the support rollers 31 and 32. The upstream anti-vibration roller 132 is at a value x with respect to the reference level R, that is, below this reference level R. Thus, the web 20 is also accompanied upstream of the support rollers 31 and 32 according to a convex or other shape, which improves tensioning of the web 20 upstream of the printing modules 41 and 42.

The support and stabilization unit 300 comprises two anti-vibration rollers 131, 132 which are positioned on either longitudinal side of the support rollers 31, 32, and the highest point of the anti-vibration rollers is positioned at a lower height than the highest point of the support rollers 31, 32, with a separation of value x with respect to the reference level R (see FIG. 4).

Figure 5:
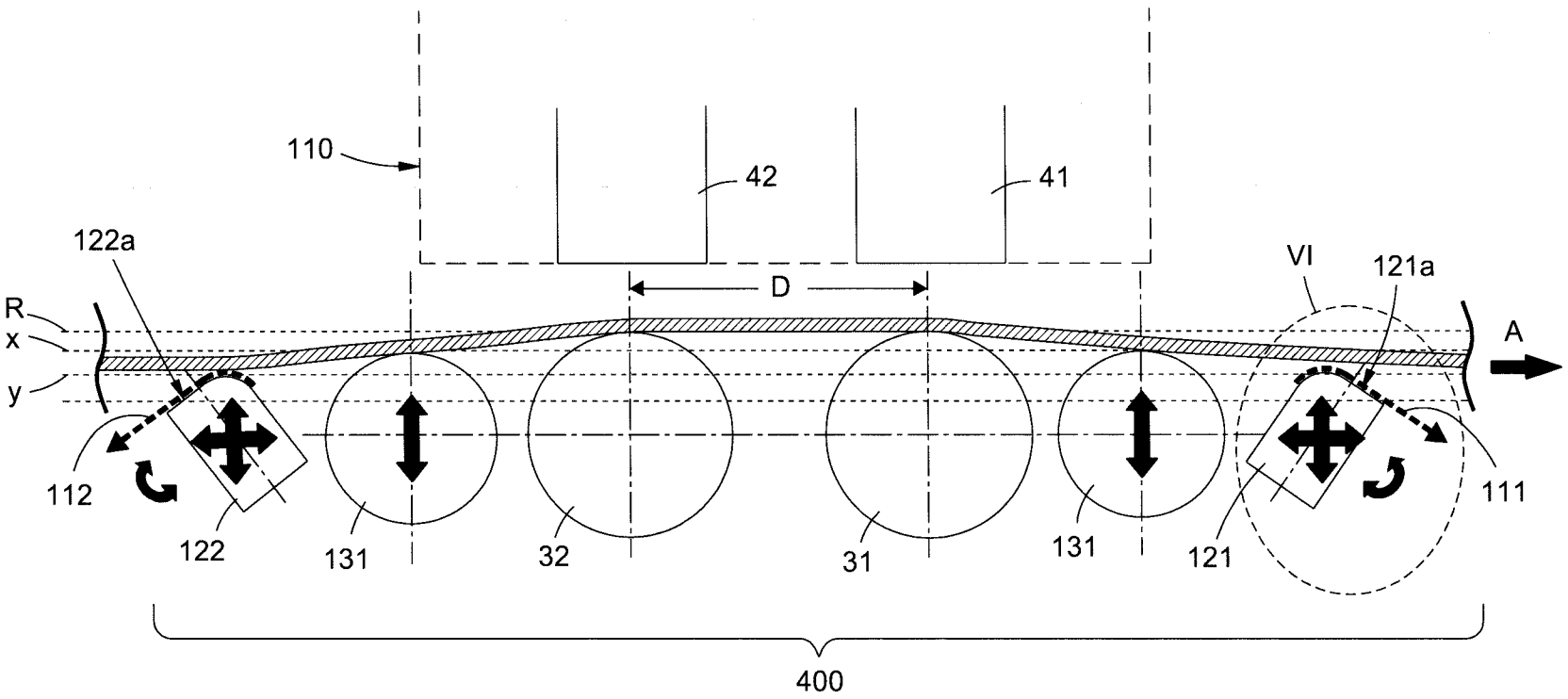

In FIG. 5, printing head 110 is equipped with a support and stabilization unit 400 according to a third embodiment. Furthermore, this support and stabilization unit 400 comprises a second tensioning device 122 positioned upstream of the upstream support roller 32 and of the support and stabilization unit 400. This upstream tensioning device 122 is similar to the downstream tensioning device 121 and creates an upstream flow of air 112 between a guiding face and the web 20.

In the case of the support and stabilization unit 400 according to the third embodiment, the outlet opening of the upstream tensioning device 122 is located downstream of the guiding face such that the upstream flow of air 112 is oriented from downstream to upstream in FIG. 5, counter to the direction of advance of the web 20. This upstream tensioning device 122 draws the web downward, toward the guiding face, and these two are separated by the flow of air that flows counter to the advancing motion of the web 20. As in the case of FIG. 3, the flow of air 112 leaving the upstream tensioning device 122 produces suction which applies, to the web, a force F2 which is essentially vertical and oriented downward along the guiding face 122*a*, and a driving force which is essentially horizontal and oriented upstream, counter to the force F1 of FIG. 3, above the slot.

The resulting tension forces T and T' exerted on the web 20 by all of the elements of the support and stabilization unit 400 are shown in FIG. 3, in addition to the forces F1 and F2 of the downstream tensioning device 121. The segment of the web is subjected, downstream, to a tension T which is horizontal and oriented downstream, and, upstream, to a tension T' which is horizontal and oriented upstream. Thus, the tensions T and T' cancel each other out either completely or partially but also pull the web taut between devices 121 and 122.

Figure 6:
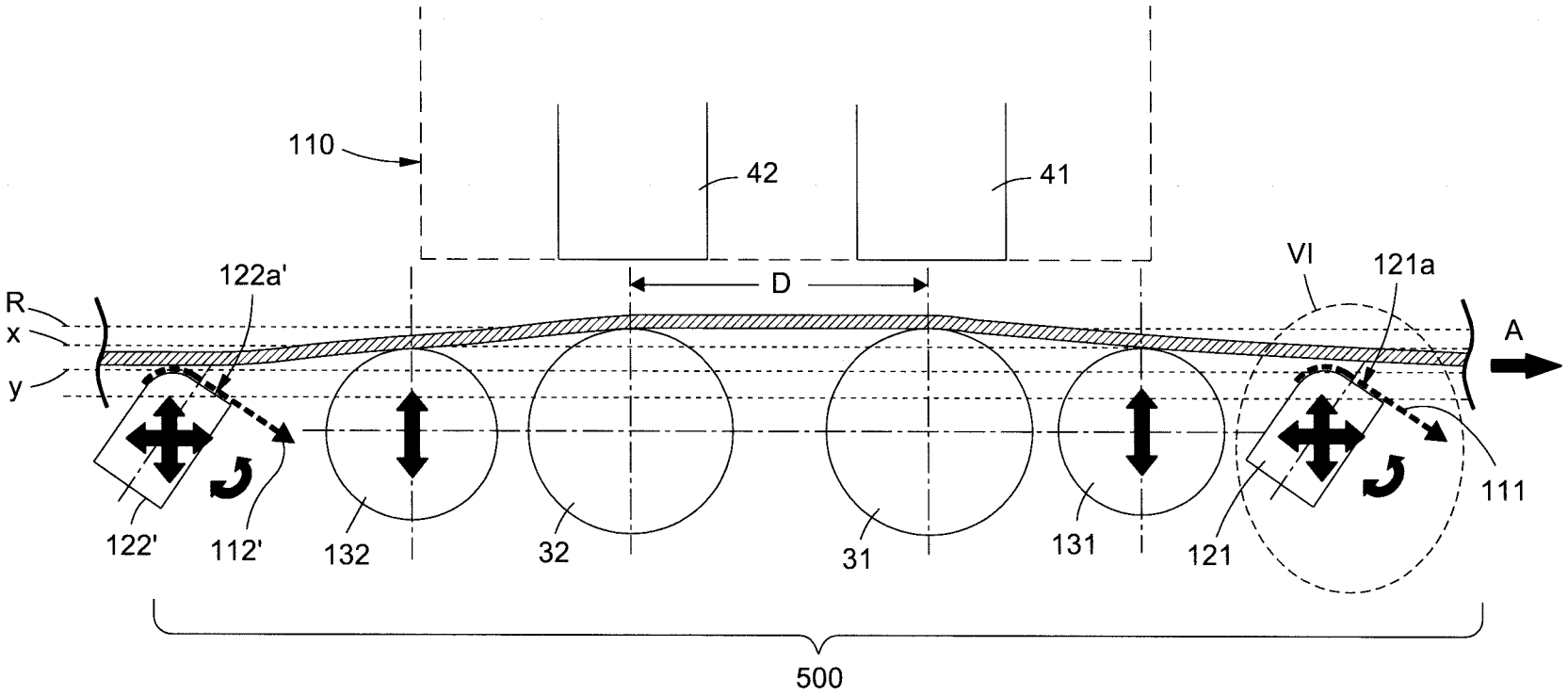

A printing head 110 is equipped with a support and stabilization unit 500 according to a fourth embodiment (FIG. 6). The only difference from the fourth embodiment is that the outlet opening of the upstream tensioning device 122' is located upstream of the guiding face. In this case, the upstream tensioning device 122' has the effect of the web 20 being drawn downward, toward the guiding face, and these two are separated by the flow of air that accompanies the advancing motion of the web 20. As in the case of FIG. 3, the flow of air 112' leaving the upstream tensioning device 122' produces suction which applies, a force F2 to the web, which is essentially vertical and oriented downward along the guiding face 122*a*', and a driving force which is essentially horizontal and oriented downstream, in the same sense as the force F1 of FIG. 3, above the slot.

According to one preferred arrangement, the support and stabilization unit 400 (FIG. 5) or 500 (FIG. 6) comprises two tensioning devices 121 and 122. In a general manner, these two tensioning devices 121 and 122 are located on either side of the one or more support rollers 31 and 32, in particular in the case of there being no anti-vibration roller 131, 132. In the presence of two anti-vibration rollers 131 and 132, the two tensioning devices 121 and 122 are located on either side of the anti-vibration rollers 131 and 132 which are themselves arranged on either side of the one or more support rollers 31 and/or 32.

This implements a method for stabilizing the web, in which, on either side of the rotating support roller 31 and/or 32, a flow of air having a velocity greater than the web speed is sent between the web 20 and a guiding face located below the segment of the web. This forms, on either side of the rotating support roller, a flow of air which draws downward the segment of the web opposite the guiding face, so as to keep the web at the level of the body.

Thus, depending on the intensity, the point of application and the orientation of the forces F1 and F2 which have to be applied in order to stabilize the web 20, one or two tensioning devices 121 and/or 122 and/or 122' are used. For each tensioning device, the side on which is located the slot via which the flow of air exits, and consequently the orientation of the flow of air, is chosen, and the height and angular orientation of each tensioning device is adjusted.

Figure 7:
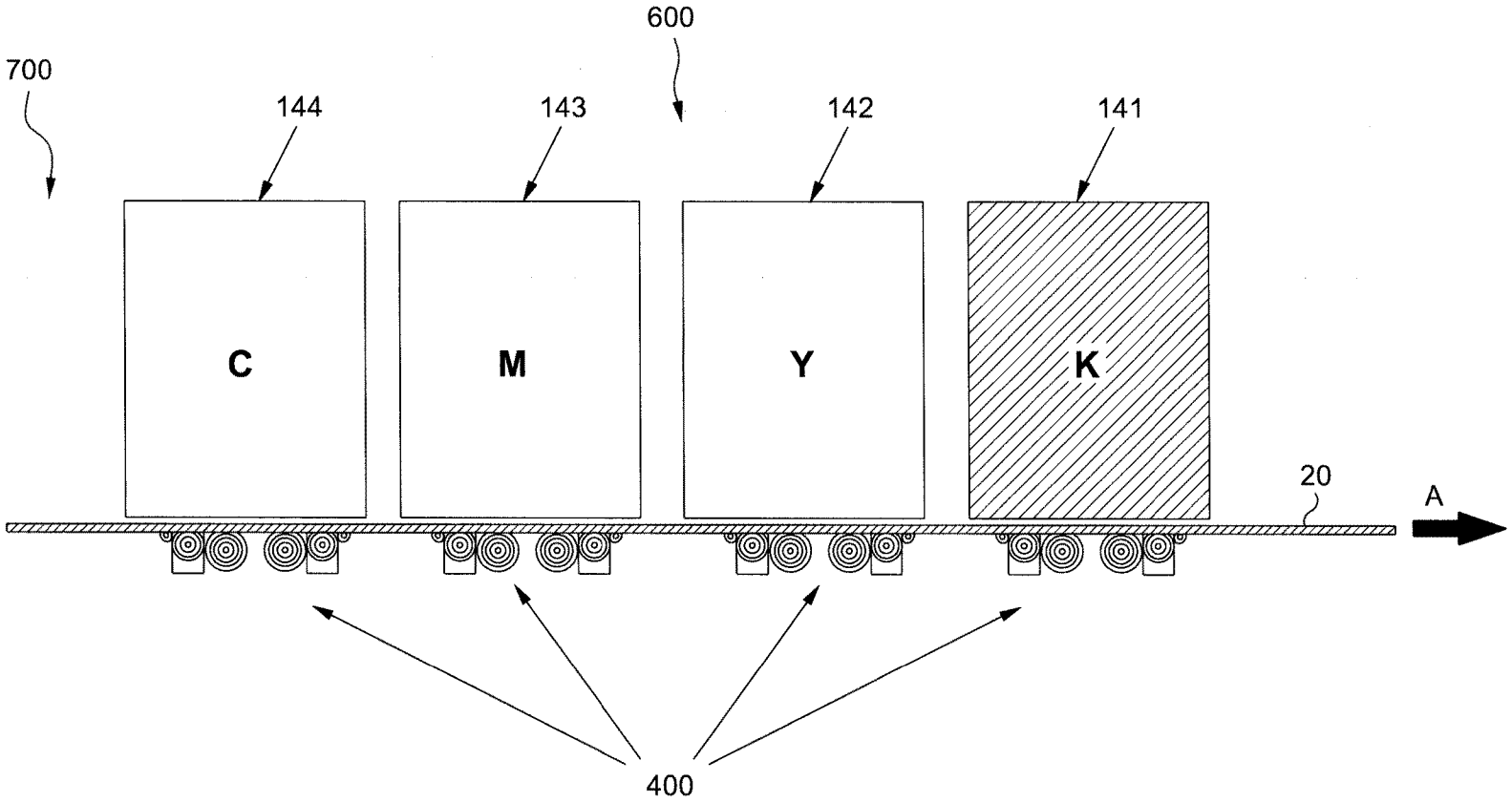
FIG. 7 shows an embodiment of a printing machine according to the invention.

In a printing machine 700 FIG. 7, a station 600 is equipped with four digital printing heads 141, 142, 143 and 144. Each head may deliver ink of a different color chosen for instance from cyan, magenta, yellow and black (CMYK). Each one of the four digital printing heads is provided with a series of printing modules that are distributed over the width of the web. Also, a respective stabilization unit 400 corresponds to each printing head 141, 142, 143 and 144. Each one of the printing heads 141, 142, 143 and 144 of the station 600 is positioned above a stabilization unit. Each one of the printing modules of a head is positioned opposite the respective support roller.

The invention claimed is:

1. A support and stabilization unit for a web being advanced in its longitudinal direction over the unit from upstream to downstream, the unit comprising in series:

at least one rotating support roller that is configured to contact an underside of the web, and at least one tensioning device configured and operable for tensioning the web, the tensioning device comprising:

a guiding face oriented toward the underside of the web, an internal cavity of the device connected to an outside of the tensioning device and an air outlet opening from the tensioning device which is oriented toward the guiding face, and an air inlet inside the internal cavity configured for communicating air to the outlet opening, so that air exiting the outlet opening produces, on the web, a force oriented toward the guiding face; and at least one rotating anti-vibration roller arranged between the support roller and the tensioning device and for contacting the web.

2. The unit according to claim 1, further comprising a convex connecting face formed on the tensioning device between the outlet opening and the guiding face.

3. The unit according to claim 1, wherein a highest point of the support roller is positioned above the highest point of the guiding face for contacting with the web.

4. The unit according to claim 1, wherein an angular orientation of the tensioning device and a distance of the tensioning device with respect to the web are adjustable.

5. The unit according to claim 1, wherein the outlet opening is located at least one of upstream or downstream of the guiding face.

6. The unit according to claim 1, wherein the highest point of the anti-vibration roller is positioned above the highest point of the guiding face of the adjacent tensioning device, and below the highest point of the adjacent support roller.

7. The unit according to claim 1, comprising two adjacent rotating support rollers for contacting the underside of the web.

8. The unit according to claim 1, comprising two of the tensioning devices.

9. The unit according to claim 1, comprising two of the anti-vibration rollers which are located on either side of the support rollers, and wherein the highest point is arranged at a lower elevation than the highest point of the support rollers.

10. The unit according to claim 1, wherein the tensioning device comprises an air manifold which delimits the internal cavity and wherein the external face comprises the guiding face, the manifold having a slot that connects the internal cavity to the guiding face and that delimits the outlet opening.

11. The unit according to claim 10, wherein the manifold extends over a distance that is suitable for covering at least the width of the web.

12. A printing station equipped with at least one printing head and at least one support and stabilization unit according to claim 1, wherein the printing head is arranged above the support and stabilization unit, facing the support roller.

13. A printing machine, comprising the printing station according to claim 12, wherein each one of the printing heads is configured to deliver ink of a respective different color.

* * * * *